US007066322B2

(12) United States Patent
Wilson

(10) Patent No.: US 7,066,322 B2
(45) Date of Patent: Jun. 27, 2006

(54) TOBACCO DIPPING CUP WITH SALIVA RESERVOIR

(76) Inventor: Christopher A. Wilson, 2415 Old. St Augustine Rd. 411, Tallahassee, FL (US) 32301

( * ) Notice: Subject to any disclaimer, the term of this patent is extended or adjusted under 35 U.S.C. 154(b) by 647 days.

(21) Appl. No.: 09/951,811

(22) Filed: Sep. 14, 2001

(65) Prior Publication Data

US 2003/0052018 A1 Mar. 20, 2003

(51) Int. Cl.
*B65D 77/00* (2006.01)

(52) U.S. Cl. ..... 206/217; 4/259

(58) Field of Classification Search ..... 206/217; 229/103.1; 131/328; 4/258, 259, 283; 215/6
See application file for complete search history.

(56) References Cited

U.S. PATENT DOCUMENTS 3,288,344 A * 11/1966 Woollen et al. ..... 229/103.1
4,795,028 A * 1/1989 Wittig et al. ..... 206/217
5,325,546 A * 7/1994 Setliff ..... 4/267
5,673,789 A * 10/1997 Degraff-Eugene ..... 206/217
6,901,976 B1 * 6/2005 Bautista et al. ..... 141/340

* cited by examiner

*Primary Examiner*—Jacob K. Ackun, Jr.

(57) ABSTRACT

A beverage cup having a detachable saliva reservoir so that a user may enjoy a beverage and smokeless tobacco products simultaneously. The cup has a saliva conduit running from its upper extremity down to a saliva reservoir which screws on the bottom. The upper portion of the conduit is formed into a mouthpiece which allows the user to easily deposit the saliva without the risk of it contaminating the contents of the cup. The beverage within the cup and the saliva reservoir are separated by an internal bulkhead. Cleaning is facilitated by the fact that the reservoir screws off the bottom. Both the cup and the reservoir can then be placed in a dishwasher or washed by hand.

9 Claims, 5 Drawing Sheets

TOBACCO DIPPING CUP WITH SALIVA RESERVOIR

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of drinking vessels. More specifically, the invention comprises a drinking cup with an integral saliva conduit and reservoir, so that a user who is dipping tobacco (snuff) may use a single vessel to hold a liquid drink and hold the saliva which must be spit out of the user's mouth.

2. Description of the Related Art

Many persons enjoy the use of smokeless tobacco products. One method of using such a product is to place a small portion of tobacco between the teeth and gums—commonly referred to as "dipping." The presence of the tobacco causes the user to salivate. This saliva intermingles with the tobacco and can cause sickness if swallowed. Thus, the smokeless tobacco user commonly spits out the induced saliva.

In some circumstances—such as when playing baseball—the user can simply spit the saliva onto the ground. This option is impractical when driving a car or generally when indoors. In these cases, the user must employ a can or cup to hold the saliva. As the can or cup is not really designed for this purpose, its use can be difficult. As one example, empty soda cans do not have a sufficiently large opening to receive the saliva.

It is also true that smokeless tobacco users often like to drink a beverage while enjoying the tobacco. Since the user must carry a saliva-receiving vessel, this effectively means that two vessels must be carried (one for the saliva and one for the beverage). The prior art devices for receiving saliva from the use of smokeless tobacco are therefore limited in that they:

1. Do not provide a good design for receiving saliva; and
2. Require the carrying of two separate vessels if the user wishes to drink a beverage.

BRIEF SUMMARY OF THE INVENTION

The present invention comprises a beverage cup having a detachable saliva reservoir so that a user may enjoy a beverage and smokeless tobacco products simultaneously. The cup has a saliva conduit running from its upper extremity down to a saliva reservoir which screws on the bottom. The upper portion of the conduit is formed into a mouthpiece which allows the user to easily deposit the saliva without the risk of contaminating the contents of the cup. The beverage within the cup and the saliva reservoir are separated by an internal bulkhead. Cleaning is facilitated by the fact that the reservoir screws off the bottom. Both the cup and the reservoir can then be placed in a dishwasher or washed by hand.

The objects and advantages of the present invention are:

1. To combine a beverage container with a saliva reservoir;
2. To provide an ergonomic mouthpiece which allows the user to easily deposit the saliva into the reservoir;
3. To provide for easy cleaning of the device when it is not in use; and
4. To provide a device which can be made of molded plastic to minimize cost.

REFERENCE NUMERALS IN THE DRAWINGS

Figure 1:
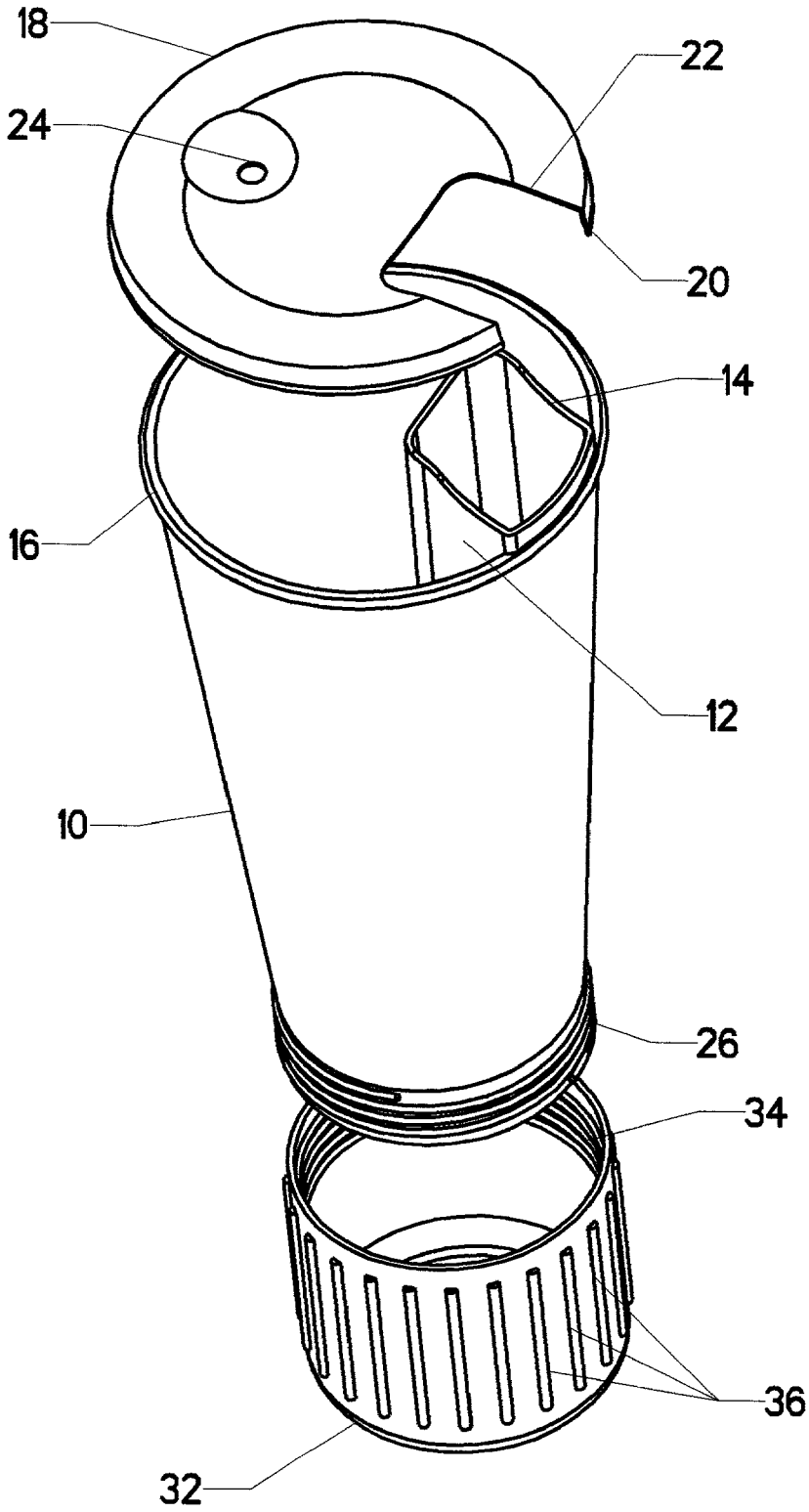
FIG. 1 is an isometric view, showing the components of the invention.

10 cup body
12 saliva conduit
14 mouthpiece
16 lip
18 lid
20 securing ring
22 mouthpiece cutaway
24 straw hole
26 male thread
28 bulkhead
30 conduit exit
32 reservoir
34 female thread
36 grip rib
38 lower wall
40 side wall
42 barrier wall

DETAILED DESCRIPTION OF THE INVENTION

Figure 2:
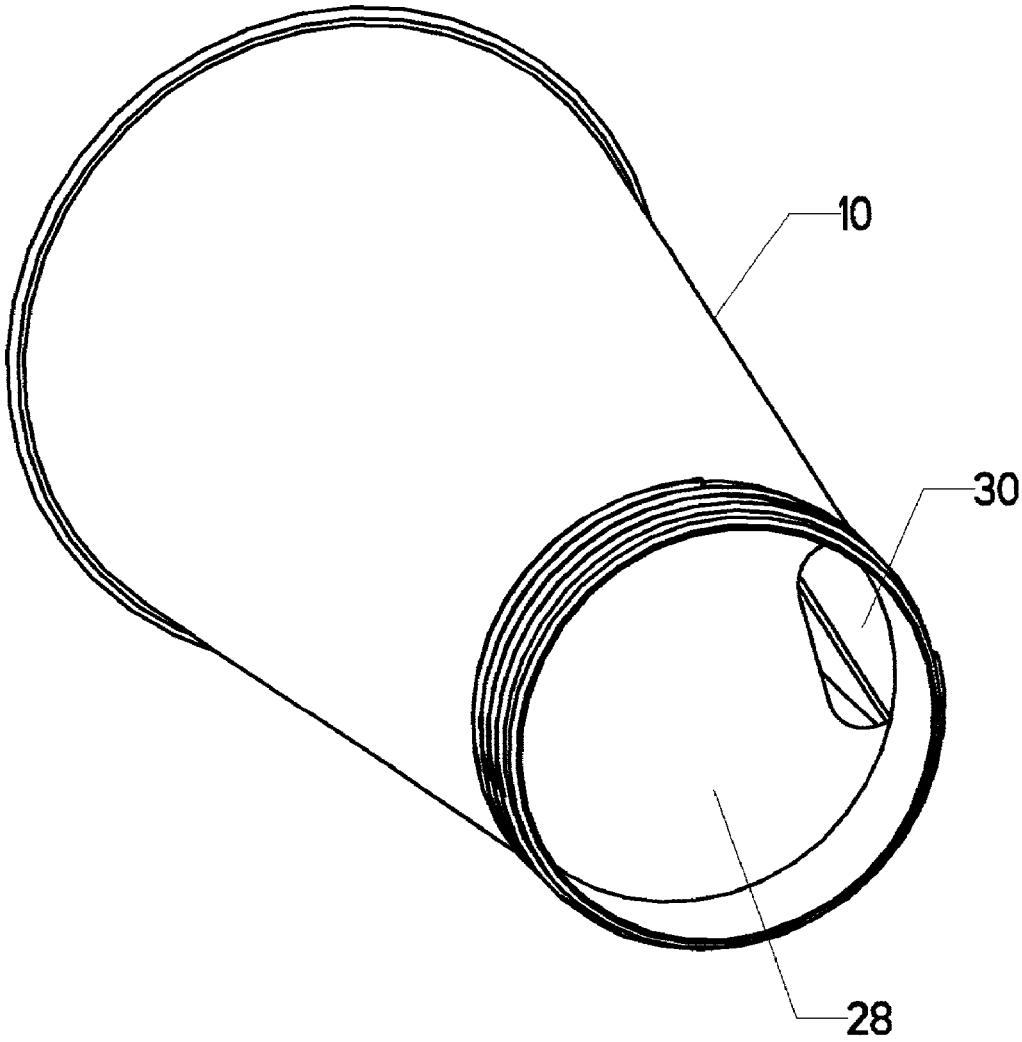
FIG. 2 is an isometric view, showing the lower details of the cup.

FIG. 1 depicts the components of the invention in a disassembled (exploded) state. The central component is cup body 10. Cup body 10 could be formed in virtually any shape. However, as many cup holders are designed to accommodate cylindrical objects, it is advantageous to create cup body 10 as a tapered cylinder. Its interior is hollow, so that it can contain the desired beverage. Its upper portion is open. Turning briefly to FIG. 2, the reader will observe that its lower portion is sealed by bulkhead 28.

Returning now to FIG. 1, the reader will observe that cup body 10 further includes saliva conduit 12. Saliva conduit 12 runs vertically from the upper portion of cup body 10 down to bulkhead 28. The upper portion of cup body 10 is formed into lip 16, which runs completely around the perimeter. The upper portion of saliva conduit 12 actually extends above lip 16 to form mouthpiece 14. Saliva conduit 12 is sealed off from the interior of cup body 10. Turning back to FIG. 2, however, the reader will observe that the lower portion of saliva conduit 12 exits the bottom of cup body 10 through conduit exit 30 in bulkhead 28.

Figure 3:
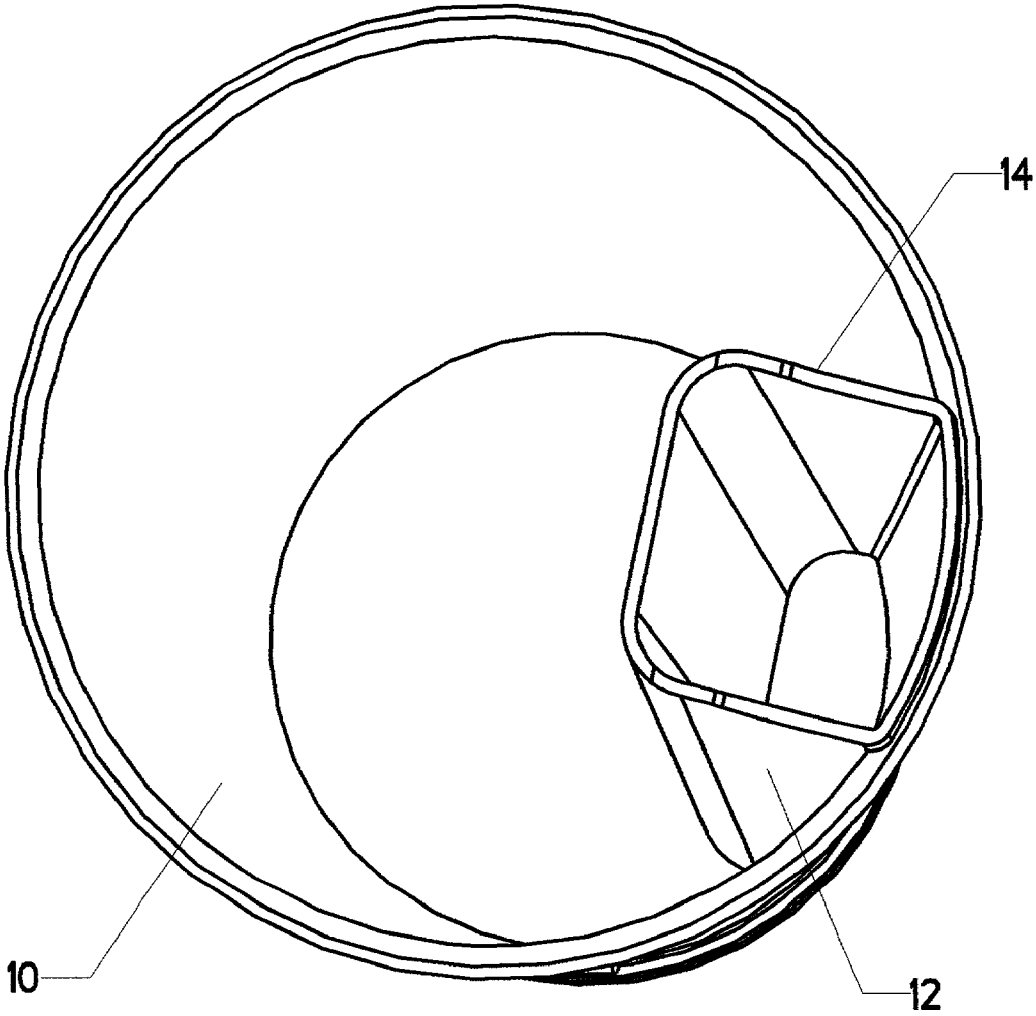
FIG. 3 is an isometric view, showing the nature of the saliva conduit.

FIG. 3 illustrates the nature of saliva conduit 12 viewed from the top. The reader will observe that saliva conduit 12 passes from the top of cup body 10 to the bottom of cup body 10. There is no fluid communication between the contents of saliva conduit 12 and the interior of cup body 10.

Returning now to FIG. 1, the other salient features of the invention will be described. Reservoir 32 is removably attached to the lower portion of cup body 10. It can be attached by a variety of conventional means (snap fits, quarter turns, etc.). As illustrated, reservoir 32 is attached by the interlocking of male threads 26 on the lower portion of cup body 10 with female threads 34 on the upper portion of reservoir 32. This method of engagement has ben found to be particularly secure. It is very important to prevent unwanted detachment of reservoir 32, as its contents may cause stains if spilled on rugs or upholstery.

Reservoir 32 is a hollow cylinder with a solid bottom. Its purpose is to accumulate the saliva deposited by the user. Grip ribs 36 are radially spaced around its perimeter to allow the user to more easily grasp reservoir 32 when removal is desired.

Lid 18 is provided to seal the open top of cup body 10. It is of conventional design, encompassing securing ring 20 to allow it to snap over lip 16 of cup body 10. It also includes straw hole 24, which allows the insertion of a drinking straw. One feature of lid 18 which is not found in the prior art is the inclusion of mouthpiece cutaway 22. This feature allows lid 18 to fit securely onto cup body 10 while still allowing mouthpiece 14 to protrude above lid 18.

Figure 5:
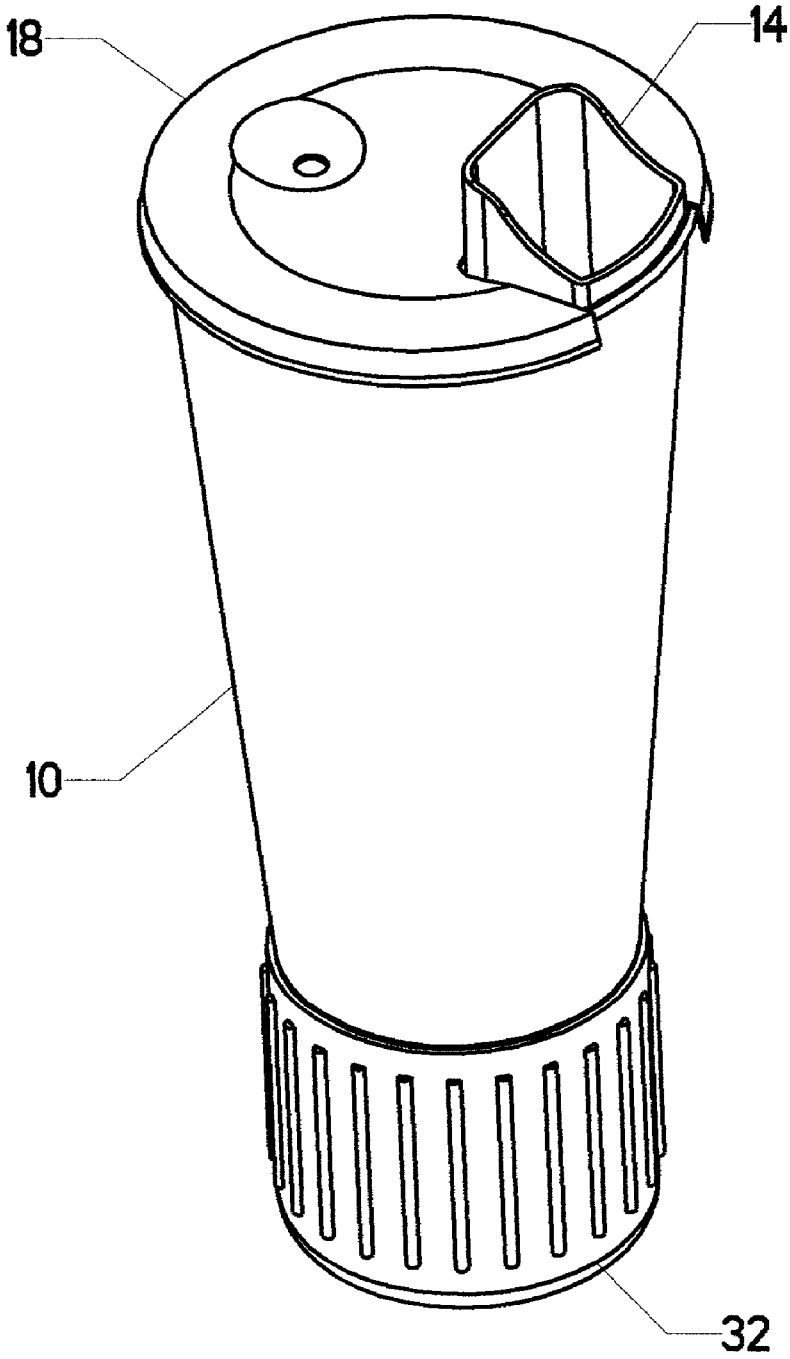
FIG. 5 is an isometric view, showing the components in the assembled state.

FIG. 5 shows the device in its assembled state. The user will note that mouthpiece 14 extends considerably above lid 18. The completed assembly has the same external dimensions as commonly available 16 to 20 ounce drinking cups. Thus, it can be inserted in prior art automotive cup holders without the need for modifications.

Figure 4:
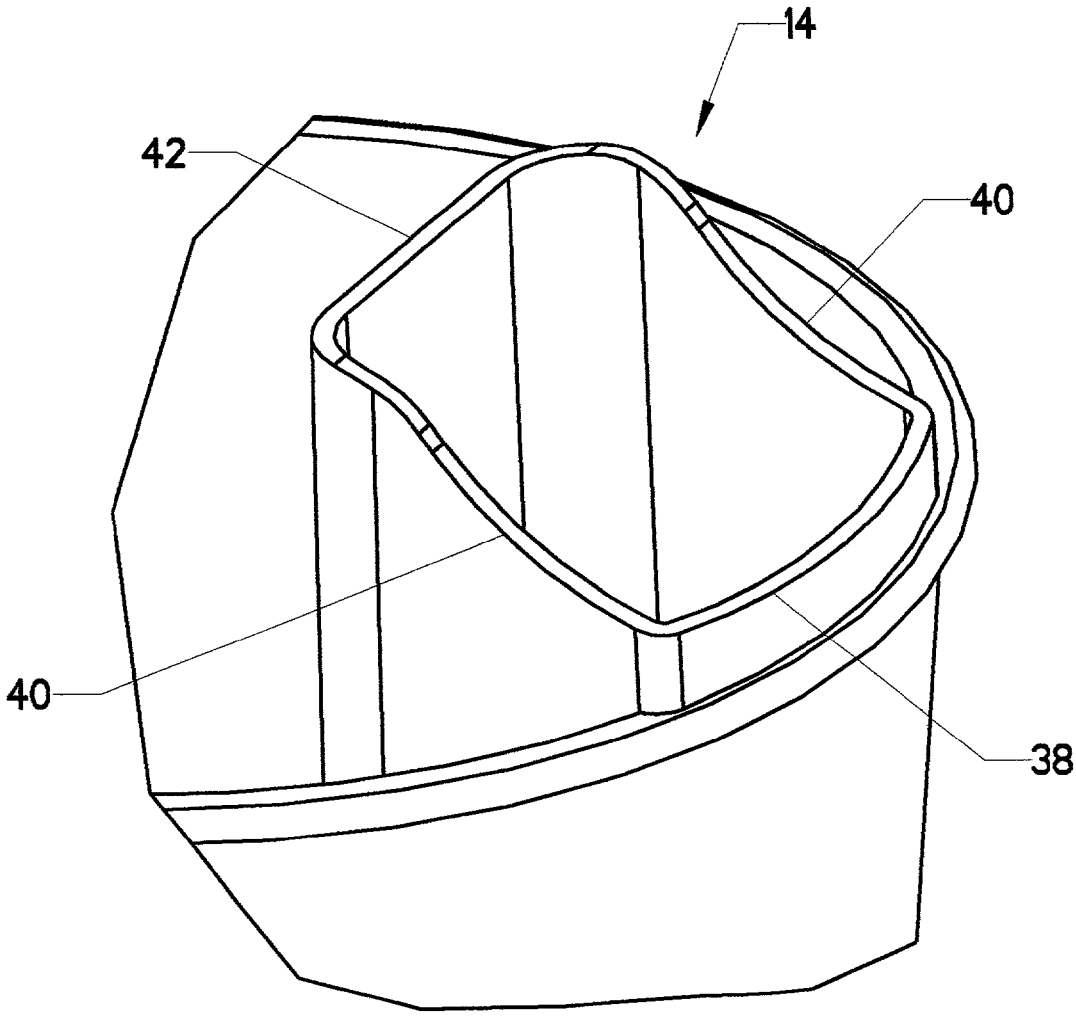
FIG. 4 is an isometric view, showing the nature of the mouthpiece.

FIG. 4 shows the design of mouthpiece 14 in greater detail. The reader will observe that mouthpiece 14 is comprised of four linked vertical walls. Lower wall 38 extend upward from the outer (circular) perimeter of cup body 10. Barrier wall 42 is positioned nearer the center of cup body 10. It extends appreciably higher than does lower wall 38. Barrier wall 42 and lower wall 38 are joined by two side walls 40. The upper extremities of these two walls slope to accommodate the differing heights between barrier wall 42 and lower wall 38. Although these upper extremities could be formed in a straight line, the use of the curved edge as shown has been found to be particularly effective. Those skilled in the art will appreciate that the overall shape of mouthpiece 14 allows the user to place his lower lip against lower wall 38 and spit saliva into saliva conduit 12 without depositing any saliva outside the conduit. Barrier wall 42 is positioned to prevent any spillage into the interior of cup body 10.

One of the main advantages of the device's construction is the ease with which it can be cleaned. When the user finishes using the device, reservoir 32 is unscrewed and dumped out. Any remaining beverage within cup body 10 is likewise dumped (with lid 18 being removed). Cup body 10, reservoir 32, and lid 18 can then be placed in a dishwasher for cleaning. Alternatively, the components can be washed by hand.

Those skilled in the art will realize that the geometry of the components disclosed was created with the prospect of injection molding the components using plastic in mind. Indeed, although the invention could be made using many manufacturing methods, molded plastic is the preferred approach. Those skilled in the art will specifically note that the wall design of saliva conduit 12 and cup body 10 enables cup body 10 to be molded as an integral unit.

The actual construction of reservoir 32 is not critical to the design. For example, the vertical walls of this reservoir could be formed integrally with cup body 10. Access could then be provided using only a detachable bottom wall. The reservoir could also be made entirely integral to the cup, with no detachable walls. The necessity of cleaning makes these variations impractical, however.

It is also significant to note that the reservoir need not be positioned on the bottom of cup body 10, or even inside the perimeter of cup body 10. It could be placed near the top, or even as an external add-on. The necessity to remove and clean the reservoir, in addition to the desire to use prior art cup holders, again makes these variations impractical. Accordingly, the embodiment disclosed in the drawing figures is the preferred embodiment.

The reader will therefore appreciate that the proposed invention combines a beverage container with a saliva reservoir. The invention has further advantages in that it:

1. Provides an ergonomic mouthpiece which allows the user to easily deposit the saliva into the reservoir;

2. Provides for easy cleaning of the device when it is not in use; and

3. Provides a device which can be made of molded plastic to minimize cost.

Although the preceding description contains significant detail, it should not be construed as limiting the scope of the invention but rather as providing illustrations of the preferred embodiment of the invention. Thus, the scope of the invention should be fixed by the following claims, rather than by the examples given.

Having described my invention, I claim:

1. A cup allowing a user to drink a beverage while simultaneously using smokeless tobacco and depositing saliva, comprising:

a. a cup body, having an interior for receiving said beverage, and having an upper end and a lower end, wherein said upper end is open and said lower end is closed;

b. a saliva conduit, having an upper end and a lower end, with said upper end being proximate said upper end of said cup and with said lower end being proximate said lower end of said cup, with said saliva conduit being isolated from said interior of said cup so as to prevent any fluid communication therebetween;

c. a reservoir, proximate said lower end of said cup, and fluidly connected to said lower end of said saliva conduit so that when said user deposits said saliva into said upper end of said saliva conduit, said saliva runs down said saliva conduit and accumulates in said reservoir;

d. wherein said upper end of said saliva conduit extends above said upper end of said cup body to form a mouthpiece, including i. a lower wall, extending upward from said outer perimeter of said cup body; and ii. a barrier wall, comprising the boundary of said mouthpiece closest to a center of said cup body.

2. A cup as recited in claim 1, wherein said reservoir is detachable from said cup.

3. A cup as recited in claim 1, wherein said barrier wall extends further upward than said lower wall.

4. A cup as recited in claim 1, further comprising a lid, sized to fit over said upper end of said cup body so as to seal said cup body.

5. A cup as recited in claim 4, wherein said lid includes a mouthpiece cutaway allowing said lid to fit over said upper end of said cup while said mouthpiece extends upward from said lid.

6. A cup allowing a user to drink a beverage while simultaneously using smokeless tobacco and depositing saliva, comprising:

a. a cup body, having an interior for receiving said beverage, and having an upper end and a lower end, wherein said upper end is open and said lower end is closed;

b. a saliva conduit, having an upper end and a lower end, with said upper end being proximate said upper end of said cup and with said lower end being proximate said lower end of said cup, with said saliva conduit being isolated from said interior of said cup so as to prevent any fluid communication therebetween;

c. a reservoir, proximate said lower end of said cup, and fluidly connected to said lower end of said saliva conduit so that when said user deposits said saliva into said upper end of said saliva conduit, said saliva runs down said saliva conduit and accumulates in said reservoir;

d. a cup lid, sized to fit over said upper end of said cup body so as to seal said cup body, said cup lid further comprising:

i. a cutaway for receiving said saliva conduit;

ii. a straw hole opening into said interior of said cup body when secured to said cup body;

e. wherein said saliva conduit and said cup body form one integral unit; and f. wherein said upper end of said saliva conduit extends above said upper end of said cup body and said cup lid.

7. A cup as recited in claim 6, wherein said reservoir is detachable from said cup body.

8. A cup as recited in claim 6, wherein said upper end of said saliva conduit extends above said upper end of said cup body to form a mouthpiece, including a. a lower wall, extending upward from said outer perimeter of said cup body; and b. a barrier wall, comprising the boundary of said mouthpiece closest to a center of said cup body.

9. A cup as recited in claim 7, wherein said upper end of said saliva conduit extends above said upper end of said cup body to form a mouthpiece, including a. a lower wall, extending upward from said outer perimeter of said cup body; and b. a barrier wall, comprising the boundary of said mouthpiece closest to a center of said cup body.

* * * * *